US010676314B2

(12) United States Patent
Van Dijk et al.

(10) Patent No.: US 10,676,314 B2
(45) Date of Patent: Jun. 9, 2020

(54) DESTINATION CALL CONTROL FOR DIFFERENT TRAFFIC TYPES

(71) Applicants: Maarten Van Dijk, Rijswijk (NL); Manfred Van Der Heijden, Zoetermeer (NL)

(72) Inventors: Maarten Van Dijk, Rijswijk (NL); Manfred Van Der Heijden, Zoetermeer (NL)

(73) Assignee: Kone Corporation, Helsinki (FI)

( * ) Notice: Subject to any disclaimer, the term of this patent is extended or adjusted under 35 U.S.C. 154(b) by 243 days.

(21) Appl. No.: 15/263,722

(22) Filed: Sep. 13, 2016

(65) Prior Publication Data

US 2016/0376122 A1 Dec. 29, 2016

Related U.S. Application Data

(63) Continuation of application No. PCT/EP2014/058580, filed on Apr. 28, 2014.

(51) Int. Cl.
*B66B 1/34* (2006.01)
*B66B 1/24* (2006.01)
*B66B 1/46* (2006.01)

(52) U.S. Cl.
CPC ..... *B66B 1/2408* (2013.01); *B66B 1/2466* (2013.01); *B66B 1/3476* (2013.01); (Continued)

(58) Field of Classification Search
USPC ..... 187/247
See application file for complete search history.

(56) References Cited

U.S. PATENT DOCUMENTS 3,837,436 A * 9/1974 Hirasawa ..... B66B 1/18 187/382
5,841,084 A * 11/1998 Thangavelu ..... B66B 1/2458 187/382

(Continued)

FOREIGN PATENT DOCUMENTS

WO WO-2010/139846 A1 12/2010
WO WO-2013/080276 A1 6/2013

OTHER PUBLICATIONS

Chinese Office Action for corresponding Chinese Application No. 201480078106.1 dated Jun. 5, 2018.

(Continued)

*Primary Examiner* — Christopher Uhlir
(74) *Attorney, Agent, or Firm* — Harness, Dickey & Pierce, P.L.C.

(57) ABSTRACT

The invention relates to a method for allocating elevators of an elevator group to landing calls given in the elevator group, the elevator group having a control unit having a destination call control, which elevator control unit is connected to determining means for the prevailing traffic condition in the elevator group. Further the control unit comprises at least a first and second operating mode which are selected according to the prevailing traffic condition, wherein the first operating mode uses immediate call allocation of the elevators which includes the display of the allocated elevator on a destination operating panel immediately after having issued a landing call and wherein the second mode comprises the allocation of an elevator to a landing call before the arrival of the allocated elevator call to the landing where the landing call has been issued. The invention allows an adaption of destination control to different traffic situations.

20 Claims, 2 Drawing Sheets

Figure 1:
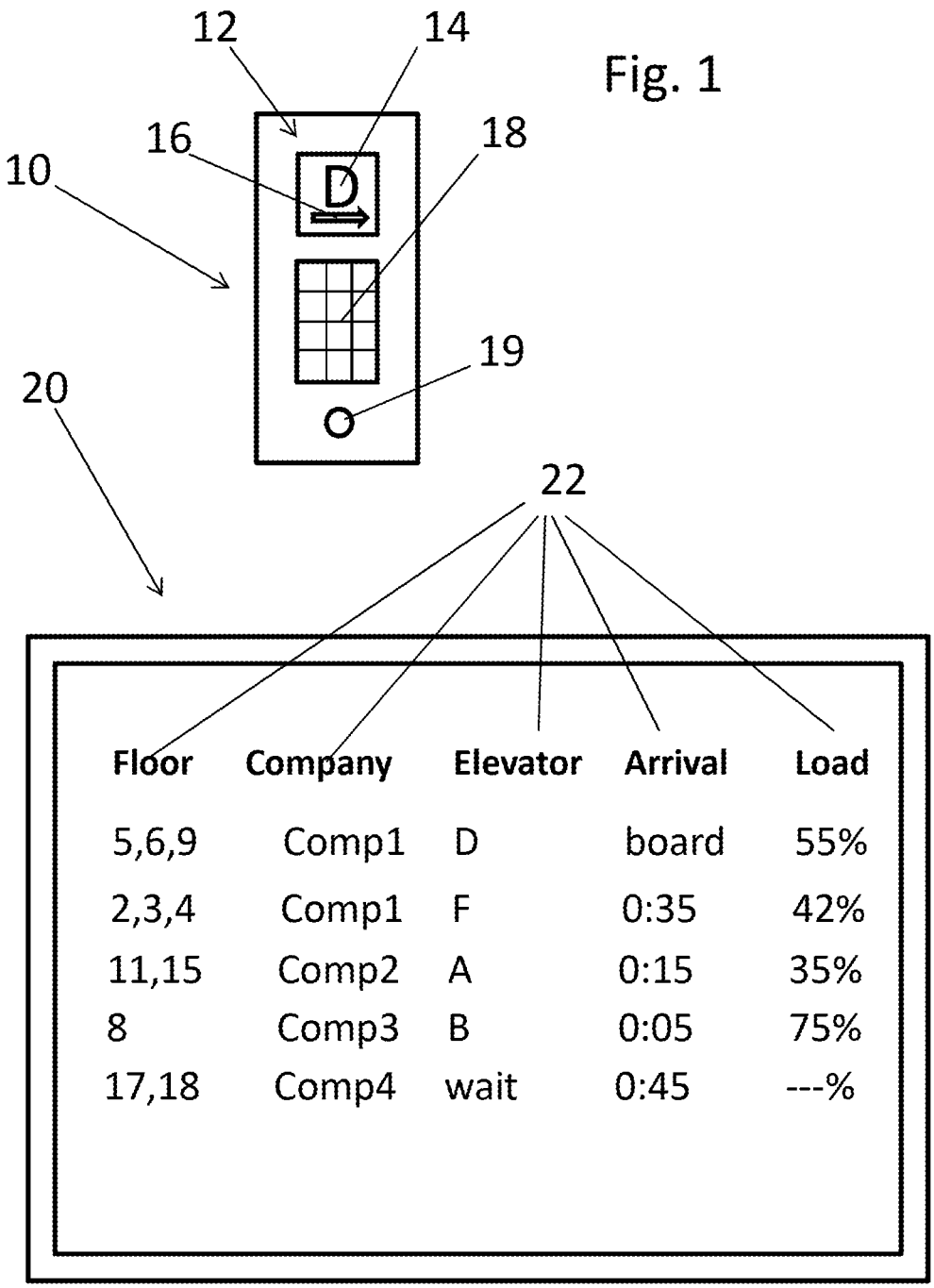

(52) U.S. Cl.
CPC ..... *B66B 1/468* (2013.01); *B66B 2201/233* (2013.01); *B66B 2201/401* (2013.01); *B66B 2201/402* (2013.01); *B66B 2201/403* (2013.01); *B66B 2201/404* (2013.01); *B66B 2201/405* (2013.01)

(56) References Cited

U.S. PATENT DOCUMENTS

| | | | | |
|---|---|---|---|---|
| 6,360,849 | B1 * | 3/2002 | Hikita | B66B 1/18 187/381 |
| 7,510,054 | B2 * | 3/2009 | Bahjat | B66B 1/18 187/247 |
| 7,694,781 | B2 * | 4/2010 | Sorsa | B66B 1/2458 187/382 |
| 8,136,636 | B2 * | 3/2012 | Bahjat | B66B 1/463 187/391 |
| 2005/0098391 | A1 * | 5/2005 | Rintala | B66B 1/20 187/396 |
| 2009/0050417 | A1 * | 2/2009 | de Groot | B66B 1/2458 187/387 |
| 2012/0090922 | A1 | 4/2012 | Elomaa et al. | |
| 2012/0160612 | A1 | 6/2012 | de Groot | |

OTHER PUBLICATIONS

International Search Report PCT/ISA/210 for International Application No. PCT/EP2014/058580 dated Jan. 28, 2015.
Written Opinion of the International Searching Authority PCT/ISA/237 for International Application No. PCT/EP2014/058580 dated Jan. 28, 2015.

* cited by examiner

DESTINATION CALL CONTROL FOR DIFFERENT TRAFFIC TYPES

This application is a continuation of PCT International Application No. PCT/EP2014/058580 which has an International filing date of Apr. 28, 2014, the entire contents of which are incorporated herein by reference.

The present invention relates to a method for allocating elevators of an elevator group to landing calls given in the elevator group, whereby the elevator group has a control unit using destination call control.

Usually, destination call control is correlated to immediate call allocation which means that after having issued a landing call, the passenger is immediately informed about the allocated elevator which is to serve the call. This method has the advantage that the elevator control obtains from a landing call of the departure floor as well as the destination floor and is therefore better able to optimize the call allocation in total compared to normal up/down push-button control where the elevator is only informed of the departure floor and the travelling direction of a passenger. A problem may arise with destination call control using immediate call allocation when the traffic in the elevator group becomes high.

It is therefore object of the present invention to provide a method of allocating elevators to landing calls under use of destination call control which is better able to cope with different traffic conditions.

The object is solved with a method according to claim 1 and with an elevator system according to claim 11. Preferred embodiments of the invention are subject-matter of the corresponding dependent claims.

The elevator control unit of the present invention is connected to a determining means for the prevailing traffic condition in the elevator group. Such a determining means may for example receive signals from a load weighing device of at least one, possibly all elevators of the elevator group. The determining means may also get information from a statistical data unit which forwards the rate of occurrence and circumstances of landing calls. The determining means may possibly get data from a traffic forecast unit which is able to estimate the current traffic situation under use of the travelling history of the elevator in connection with statistical data. Also person sensors, e.g. IR sensors in the elevator lobby and/or elevators may be used to gather information about the current traffic situation. The determining means may also be time-controlled, particularly in connection with the traffic forecast unit. The control unit further comprises a first operating mode and a second operating mode which are selectable in response to data received from the determining means. By this measure the control unit is able to run in the first operating mode as long as the current traffic situation is below a certain limit value and to run in the second operating mode when the current traffic exceeds said limit value.

In the first operating mode, the destination call control works under use of immediate call allocation of the elevators to the given landing calls. In immediate call allocation the elevator is immediately (within few seconds) allocated after a passenger has issued a landing call on a destination operating panel (DOP), and thus the allocated elevator is immediately displayed on said DOP of the elevator system to said passenger. This first operating mode of the control unit makes use of the benefit of immediate call allocation in low or normal traffic situations where this allocation method is really preferable.

For heavier traffic situations, the invention provides a second operating mode where the passenger is prompted, preferably by the DOP to a common information panel to obtain information on the elevator allocated to his landing call. In this operating mode the landing call is allocated shortly before the allocated elevator arrives at the landing where the landing call has been issued. Preferably the elevator is allocated within a certain time span before the arrival of the allocated elevator at the landing. This is per se known form conventional up/down push-button control. On one side the time span has to be as short as possible to enable the control unit to make the decision about the allocation of the elevator to a landing call as late as possible, which makes it possible to consider changes in the call status of the elevator system as long as possible before the allocation is made. On the other side it has to be long enough to make the passengers realize via a look on a common information panel that their call has been allocated and that they are able to reach the allocated elevator before its arrival. Thus a reasonable time span would be between 1 and 30 seconds, preferably between 2 and 20 seconds, most preferably between 3 and 15 seconds. This time range is reasonable as it provides a lot of additional time for the destination call control to search for the optimal elevator compared with immediate call allocation. On the other hand, the time span is large enough as to enable passengers to get to the elevator from any point of the elevator lobby. The indication of elevators via the common information panel is preferably supported by acoustic signals which are activated when an elevator arrives at a landing. In the second operating mode, the passenger is preferably prompted to the common information panel e.g. by simply switching off the destination operating panel or by displaying a certain symbol that prompts the passenger to refer to the common operating panel or even by displaying a text which prompts the passenger to refer to the common information panel for getting information about the elevator which is to be allocated to his landing call.

The advantage of this second operating mode being activated in heavy traffic situations is that the control unit and the destination call control have more time to select the optimal elevator for a given landing call they are—in contrast to immediate call allocation—able to consider events, e.g. landing and/or car calls which have been given after the issuing of the landing call to be allocated. This is helpful in situations where the elevator traffic is high. Therefore, the destination call control is better able to cope with different prevailing traffic conditions as it was possible with conventional update push button control or conventional destination call control.

Accordingly, the inventive allocation method optimizes the use of destination control for low and normal traffic situations on one hand and for heavy traffic situations on the other hand so as to optimize the performance of the elevator group in total.

Preferably, the control unit comprises a third operating mode which is activated via input means, which third operating mode uses immediate call allocation and is independent of the traffic situation. This third operating mode allows handicapped people or VIP people to get an elevator always immediately allocated, even in heavy traffic situations, where generally the second operating mode is used in the elevator group. The input means can be any kind of key-lock or ID tag-system as e.g. RFID tag or ID card-system. The data from the ID tag is read by a corresponding ID tag reader connected to the control unit, e.g. with the DOP.

The invention also relates to an elevator system having an elevator group comprising several elevators and a control unit with a destination call control for the call allocation in the elevator group. The control unit is further connected to determining means for the prevailing traffic condition in the elevator group. According to the invention, the control unit comprises at least a first and second operating mode which are selectable in response to data received from the determining means. In the first operating mode, the elevators are allocated via immediate call allocation, which means that an elevator is allocated immediately (within few seconds) after having issued a destination call and the allocated elevator is immediately displayed on the DOP. The destination call is inputted via the destination operating panel, e.g. on a decade keyboard. Accordingly, the control unit is configured in this first operating mode to immediately display the allocated elevator on the destination operating panel in a short period of 1 to 5 s after the call has been issued either by inputting the destination floor at the destination operating panel or by the provision of an ID tag which is read by a corresponding ID tag reader in the vicinity of or in connection with the destination operating panel.

The control unit further comprises a second operating mode in which the elevator is allocated to a landing call, preferably in a certain time span, before the arrival of the allocated elevator to the landing from where the landing call has been issued. This time span is usually within few seconds, e.g. from 1 to 30 s, which allow the control unit to prolong the time for finding an optimal elevator for the landing call and which on the other hand enables the passenger to reach the allocated elevator before its arrival at the landing. The essential features and advantages of this inventive elevator system are the same as already mentioned above with respect to the inventive method. In order to avoid repetitions it is referred to the above passages of the description.

Preferably, the determining means for the prevailing traffic in the elevator group comprises a connection to at least one weighing device of the elevators. Via this measure, the determining means obtains actual load data from the elevators via which it is able to conclude on the number of passengers in the car and correspondingly to the prevailing traffic in the corresponding elevator.

In a further preferable embodiment of the invention, the determining means comprises a traffic forecast unit which again comprises a memory with the travel history data and statistical data of the elevator group. From the traffic forecast unit the determining means is able to gather current traffic data based on historical and statistical data without needing actual traffic data.

Preferably, the elevator system comprises a common information panel arranged in the elevator lobby which is activated by the control unit when running in the second operating mode. Via this common information panel, all passengers on a landing may get information about the different destinations of the different elevators. Optionally further information may be given to the passengers as e.g. the waiting time and the load of the different active elevators. Alternatively, it is of course possible to provide only acoustic or visual indicating means to inform a passenger about the arrival of an elevator and to indicate the destination floors, e.g. on a central information panel or on information panels arranged on the top of one or several elevators.

Preferably, the elevator system comprises a destination operating panel with an input means, e.g. a key lock, ID tag device or any other switch by which a passenger is able to switch the control unit into a third operating mode wherein always immediate call allocation is used independent of the current traffic situation. It is hereby clarified that the third operating mode is only used for those calls issued by the input means, i.e. by handicapped or VIP persons. All other landing calls are issued in the first or second operating mode dependent on the current traffic situation. With such an input means handicapped people are able to get immediately allocated an elevator independent of the prevailing traffic situation. In this case, the destination call control may also be operated as to allocate an elevator allocated to the landing call in the third operating mode with a higher priority than all any other landing calls. This can be done by correspondingly adapt the parameters of a cost function used in the call allocation.

The input means may also comprise an ID tag reader which automatically gathers ID data of a handicapped or VIP passenger so that in case the destination operating panel is approached by such a person automatically an elevator is allocated in the third operating mode.

Some inventive embodiments are also presented in the descriptive section and in the drawings of the present application. The inventive content may also consist of several separate inventions, especially if the invention is considered in the light of expressions or implicit subtasks or from the point of view of advantages or categories of advantages achieved. In this case, some of the attributes contained in the claims below may be superfluous from the point of view of separate inventive concepts. The features of the various embodiments of the invention can be applied within the framework of the basic inventive concept in conjunction with other embodiments.

The terms "landing call" and "destination call" are used as synonyms. The terms "landing" and "floor" are used as synonyms.

The above described embodiments can be combined with each other arbitrarily as long this is technically feasible.

The change between first and second operating mode may not only be controlled via the traffic but may alternatively or additionally also be time controlled, e.g. via the seasons and/or day-time, preferably in connection with a traffic forecast unit.

The invention will now be described by the aid of the schematic drawing.

Figure 2:
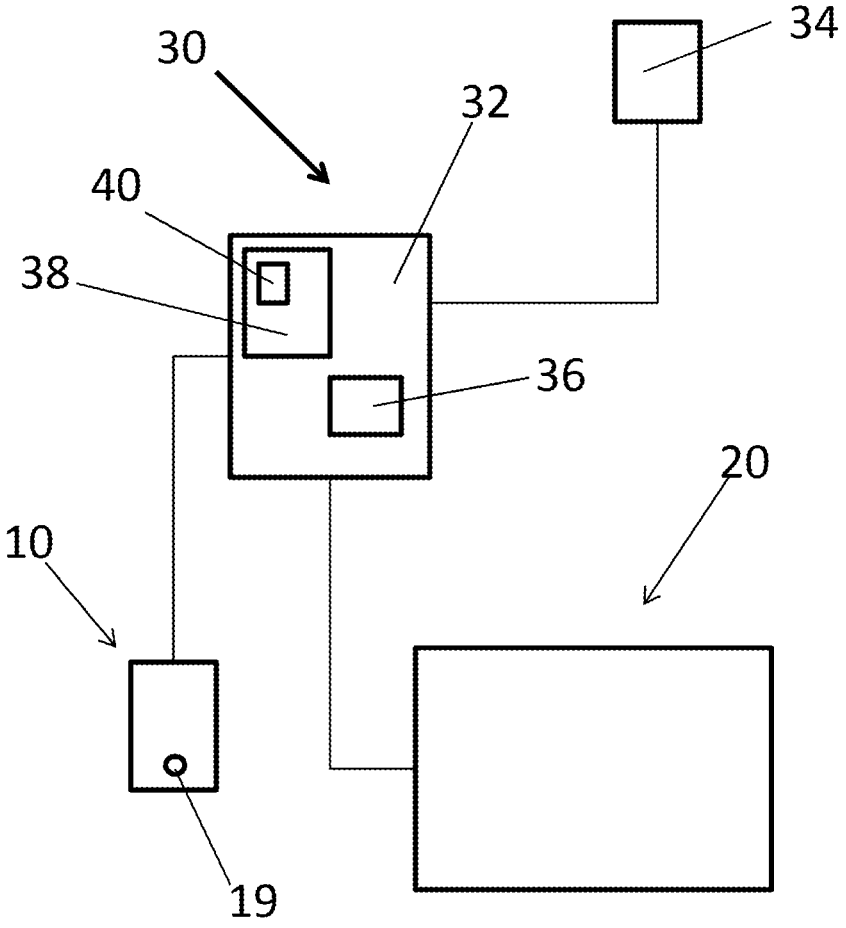

FIG. 1 shows a front view of a destination operating panel and a common information panel, and FIG. 2 shows a schematic illustration of the essential components of an elevator system in connection with the control unit for running a control unit with a destination call control in two different operating modes.

FIG. 1 shows a destination operating panel 10 having a display 12 for indicating the ID-number 14 of an allocated elevator and an arrow 16 showing the walking direction to the elevator from the location of the destination operating panel 10. The destination operating panel 10 further comprises a decade keyboard 18 for inputting a destination floor and eventually input means 19 for starting a third operating mode for handicapped or VIP persons.

FIG. 1 further shows a common information panel 20 having five columns 22 showing in the first column the destination floor of all running elevators, in the second column the name of companies being located on the different destination floors, the third number the ID-number of the elevator, usually a digit or number, the fourth column the expected arrival time and the fifth column the current load of the elevator. Via this common information panel, a passenger is able to easily find the elevator which is allocated to his particular destination floor. Further he can see from the common information panel when this allocated elevator is expected to arrive and how much it is loaded. The indication of the data in the second, fourth and fifth column is optional.

The destination operating panel 10 may also comprise an ID tag reader as e.g. an RFID reader or a card reader.

FIG. 2 shows the essential control components of an elevator system 30 comprising a control unit 32 connected to at least one destination operating panel 10 on preferably each landing. Further, the control unit 32 is connected to regularly one or two common information panels 20 preferably on each landing. The control unit 32 is further connected to at least one load weighing device 34 provided in connection with preferably each elevator. Furthermore, the control unit 32 has a destination call control 36 which is provided in a module or is software implemented in the control unit 32. The control unit further has optionally a traffic forecast unit 38 with a memory 40 with historical and statistical traffic data. Also the traffic forecast unit 38 may be provided as a module of the control unit 32 or maybe software-implemented.

The elevator system 30 works as follows:

The destination call control 36 of the control unit 32 checks preferably continuously the prevailing traffic situation by gathering and analyzing data from the weighing device 34 and from the traffic forecast unit 38. Also the number or rate of occurrence of the open landing calls and serviced landing calls within a certain time frame are used by the destination call control 36 to calculate the prevailing traffic situation. If the traffic is below a certain limit value, the elevator system 30 runs with immediate call allocation in which after the input of a destination floor via the decade keyboard 18 on the destination operating panel 10, an elevator is allocated which is immediately, i.e. within a few seconds, indicated to the passenger on the display 12 of the destination operating panel 10. The change between first and second operating mode may also be time controlled.

If the traffic exceeds the limit value, either nothing is displayed on the destination operating panel or a prompt is displayed which refers the passenger to at least one common information panel in the elevator lobby easily to notice by all passengers in the elevator lobby. This is in contrast to the DOP 10 wherein the display 12 is intended to show the allocated elevator only to the passenger having issued the call on the DOP. On the common information panel 20, the destination floors of each running elevator is indicated so that a passenger is able to look which elevator is to serve his destination floor. In this case, the control unit, particularly the destination call control, is able to allocate an elevator up to a short time span before its arrival at the floor where the landing call has been issued (i.e. the departure floor). This gives the control unit additional time to consider time after the issuing of the landing call to find and/or allocate the best suited elevator to serve the landing call. The common information panel may be one central information panel located in the elevator lobby or it may be embodied as several information panels located at different points of the elevator lobby, e.g. at its ends or for example in top of each elevator.

The indication of the arrival of an elevator may also be assisted by acoustic indication.

Preferably, the destination operating panel has an ID tag reader 19, e.g. an RFID reader which automatically sets the control system to a third operating mode where always immediate call allocation is performed, in which case the allocated elevator is shown to the passenger on the display 12 immediately after having issued the landing call via the decade keyboard 18. Of course, when the elevator system is currently running in the second operating mode, this additional destination may also be displayed on the common information panel 20.

The invention is not limited to the above embodiments but may be varied within the scope of the appended patent claims.

Accordingly, it is not necessary that the common information panel displays the companies which are served according to the different destinations or the load data or expected arrival time.

It is further obvious that the different components of the elevator system 30 as shown in FIG. 2 may be distributed as several hardware components within the elevator group or may be arranged in a central location which is well accessible by a maintenance operator. Some components as for example the weighing device 34, the destination operating panel 10 and the common information panel 20 may be located as a single element or as several elements on preferably each of the floors served by the elevator group.

The invention claimed is:

1. A method of allocating elevators of an elevator group to landing calls given in the elevator group, the elevator group having a controller configured to perform destination call control the method comprising:

collecting traffic condition data indicating a prevailing traffic condition in the elevator group; and switching whether the controller, allocates elevators of the elevator group via at least a first operating mode or a second operating mode based on the prevailing traffic condition such that in the first operating mode the controller is configured to (i) immediately perform an allocation of one of the elevators to an associated one of the landing calls as an allocated elevator and (ii) display the allocated elevator on a destination operating panel, and in the second operating mode the controller is configured to (i) delay the allocation and analyze the prevailing traffic condition during the delay while the elevators of the elevator group are operating such that an amount of time from an associated one of the landing calls to when the controller determines the allocated elevator is longer when the controller operates in the second operation mode having the delay associated therewith as compared to the first operating mode and (ii) switch from utilizing the destination operating panel to display the allocated elevator to utilizing a common information panel to display the allocated elevator such that the controller is configured to utilize different panels based on whether the controller allocates elevators via the first operating mode or the second operating mode.

2. The method according to claim 1, further comprising:

displaying, on the common information panel, data indicating at least destination floors associated with outstanding ones of the landing calls and the allocation of the elevators to associated ones of the landing calls in response to the controller operating in the second operating mode, the common information panel being a separate panel from the destination operating panel.

3. The method according to claim 1, further comprising:

prompting, on the destination operating panel, passengers of the elevator group to obtain information about the allocation from the common information panel.

4. The method according to claim 1, further comprising:

obtaining load data from load weighing devices of the elevators.

5. The method according to claim 1, further comprising: obtaining call data from the destination call control.

6. The method according to claim 1, further comprising: obtaining statistical traffic data from a traffic forecast unit.

7. The method according to claim 1, further comprising: switching to a third operating mode in response to user input via an input device such that, in the third operating mode the controller performs immediate call allocation independent of the prevailing traffic condition.

8. The method according to claim 7, wherein the input device is an ID tag reader of the elevator group.

9. The method according to claim 1, further comprising: allocating, in the second operating mode, one of the elevators to an associated one of the landing calls such that the allocation is delayed to within a time span before an arrival of the one of the elevators at a landing where an associated one of the landing calls has been issued.

10. The method according to claim 9, wherein the time span is between 1 and 10 seconds.

11. An elevator system comprising:

a controller configured to perform destination call control for allocating elevators of an elevator group of elevators to landing calls given in the elevator group by, collecting traffic condition data indicating a prevailing traffic condition in the elevator group, and switching whether the controller allocates the elevators of the elevator via at least a first operating mode or a second operating mode based on the prevailing traffic condition such that in the first operating mode the controller is configured to (i) immediately perform an allocation of one of the elevators to an associated one of the landing calls as an allocated elevator and (ii) display the allocated elevator on a destination operating panel, and in the second operating mode the controller is configured to (i) delay the allocation and analyze the prevailing traffic condition during the delay while the elevators of the elevator group are operating such that an amount of time from an associated one of the landing calls to when the controller determines the allocated elevator is longer when the controller operates in the second operation mode having the delay associated therewith as compared to the first operating mode and (ii) switch from utilizing the destination operating panel to display the allocated elevator to utilizing a common information panel to display the allocated elevator such that the controller is configured to utilize different panels based on whether the controller allocates elevators via the first operating mode or the second operating mode.

12. The elevator system according to claim 11, wherein the controller is configured to obtain load data from at least one weighing device of the elevators.

13. The elevator system according to claim 11, wherein the controller is configured to obtain statistical traffic data from a traffic forecast unit.

14. The elevator system according to claim 11, further comprising:

the common information panel arranged in an elevator lobby, the common information panel configured to display data indicating at least destination floors associated with outstanding ones of the landing calls and the allocation of the elevators to associated ones of the landing calls in response to the controller operating in the second operating mode, the common information panel being a separate panel from the destination operating panel.

15. The elevator system according to claim 11, wherein the destination operating panel comprises:

an input device for activating a third operating mode using immediate call allocation.

16. The elevator system according to claim 15, wherein the input device is an ID tag reader.

17. A controller comprising:

a memory and a processor, the memory containing computer readable code that, when executed by the processor, configures the processor to perform destination call control for allocating elevators of an elevator group of elevators to landing calls given in the elevator group by, collecting traffic condition data indicating a prevailing traffic condition in the elevator group, and switching whether the controller allocates the elevators of the elevator group via at least a first operating mode or a second operating mode based on the prevailing traffic condition such that in the first operating mode the controller is configured to (i) immediately perform an allocation of one of the elevators to an associated one of the landing calls as an allocated elevator and (ii) display the allocated elevator on a destination operating panel, and in the second operating mode the controller is configured to (i) delay the allocation and analyze the prevailing traffic condition during the delay while the elevators of the elevator group are operating such that an amount of time from an associated one of the landing calls to when the controller determines the allocated elevator is longer when the controller operates in the second operation mode having the delay associated therewith as compared to the first operating mode and (ii) switch from utilizing the destination operating panel to display the allocated elevator to utilizing a common information panel to display the allocated elevator such that the controller is configured to utilize different panels based on whether the controller allocates elevators via the first operating mode or the second operating mode.

18. The controller of claim 17, wherein the controller is configured to, display, on the common information panel, data indicating at least destination floors associated with outstanding ones of the landing calls and the allocation of the elevators to associated ones of the landing calls in response to the controller operating in the second operating mode, the common information panel being a separate panel from the destination operating panel.

19. The elevator system according to claim 11, wherein the controller is further configured to, prompt, on the destination operating panel, passengers of the elevator group to obtain information about the allocation from the common information panel.

20. The controller according to claim 17, wherein the controller is further configured to, prompt, on the destination operating panel, passengers of the elevator group to obtain information about the allocation from the common information panel.

* * * * *